US008733334B2

(12) United States Patent
Mroczka et al.

(10) Patent No.: US 8,733,334 B2
(45) Date of Patent: May 27, 2014

(54) TOY HAND GRENADE WITH TIMER MECHANISM

(76) Inventors: David E. Mroczka, Babylon, NY (US); Kevin Mroczka, Babylon, NY (US)

( * ) Notice: Subject to any disclaimer, the term of this patent is extended or adjusted under 35 U.S.C. 154(b) by 287 days.

(21) Appl. No.: 13/292,702

(22) Filed: Nov. 9, 2011

(65) Prior Publication Data

US 2012/0266853 A1 Oct. 25, 2012

Related U.S. Application Data

(63) Continuation-in-part of application No. 13/090,528, filed on Apr. 20, 2011, now Pat. No. 8,469,011.

(51) Int. Cl.

| | |
|---|---|
| ***F41B 7/08*** | (2006.01) |
| ***F41B 15/00*** | (2006.01) |
| ***A63B 65/00*** | (2006.01) |
| *A63H 33/00* | (2006.01) |

(52) U.S. Cl.

CPC . *F41B 7/08* (2013.01); *F41B 15/00* (2013.01); *A63H 33/009* (2013.01)

USPC ..... 124/16; 124/37; 124/1; 446/4; 446/473; 446/475

(58) Field of Classification Search

CPC ..... F41B 15/00; F41B 7/08; A63H 33/009

USPC ..... 124/16, 26, 27, 37, 1; 446/4, 6, 473, 446/475

See application file for complete search history.

(56) References Cited

U.S. PATENT DOCUMENTS

| | | | | | |
|---|---|---|---|---|---|
| 1,348,224 | A | * | 8/1920 | Kemp | 446/400 |
| 2,367,027 | A | * | 1/1945 | Jackman | 446/400 |
| 3,106,397 | A | * | 10/1963 | Lacey | 473/571 |
| 3,492,945 | A | * | 2/1970 | Filippi | 102/498 |
| 3,564,756 | A | * | 2/1971 | Yokoi | 446/4 |
| 3,878,639 | A | * | 4/1975 | Scheelar et al. | 446/473 |
| 4,319,426 | A | * | 3/1982 | Lee | 446/401 |
| 4,461,117 | A | * | 7/1984 | Gott | 446/473 |
| 4,932,329 | A | * | 6/1990 | Logie | 102/498 |
| 4,932,672 | A | * | 6/1990 | Tippmann | 473/611 |
| 4,944,521 | A | * | 7/1990 | Greeno | 473/577 |
| 5,018,449 | A | * | 5/1991 | Eidson, II | 102/498 |
| 5,069,134 | A | * | 12/1991 | Pinkney | 102/368 |
| 5,240,450 | A | * | 8/1993 | Graham | 446/267 |
| 5,354,225 | A | * | 10/1994 | Hix | 446/180 |
| 5,531,626 | A | * | 7/1996 | Deal | 446/473 |
| 5,538,456 | A | * | 7/1996 | Liu et al. | 446/473 |
| 5,590,886 | A | * | 1/1997 | Lush | 473/577 |
| 5,877,448 | A | * | 3/1999 | Denton et al. | 102/401 |

(Continued)

*Primary Examiner* — Alvin Hunter
*Assistant Examiner* — Alexander Niconovich
(74) *Attorney, Agent, or Firm* — Alix, Yale & Ristas, LLP

(57) ABSTRACT

A toy hand grenade has a plurality of bores which receive soft darts. A launcher is received in each bore and is spring loaded. An actuator retains the launchers in a spring-loaded, unactuated position. The actuator is displaceable relative to the body to release the launchers and substantially concurrently eject the darts from the hand grenade. A pin or a clip may be employed to lock the actuator in a locked position. A timer is employed to delay actuation of the actuator to release the launchers and eject the darts from the hand grenade. A sandbag ring is imposed to ensure proper orientation and stability of the hand grenade for the timer actuated feature.

20 Claims, 6 Drawing Sheets

(56) References Cited

U.S. PATENT DOCUMENTS

| | | | | |
|---|---|---|---|---|
| 5,928,049 | A * | 7/1999 | Hudson | 446/4 |
| 5,964,639 | A * | 10/1999 | Maxim | 446/437 |
| 5,975,983 | A * | 11/1999 | Panec | 446/475 |
| 5,996,503 | A * | 12/1999 | Woodall et al. | 102/498 |
| 6,311,681 | B1 * | 11/2001 | Snyder, Jr. | 124/59 |
| 6,453,819 | B1 * | 9/2002 | Coates | 102/498 |
| 6,598,807 | B1 * | 7/2003 | Anzalone | 239/302 |
| 6,688,234 | B2 * | 2/2004 | Huber et al. | 102/498 |
| 6,871,594 | B1 * | 3/2005 | Estrella | 102/498 |
| 7,275,486 | B2 * | 10/2007 | Hsieh | 102/498 |
| 7,288,016 | B2 * | 10/2007 | Juy | 446/398 |
| 7,338,343 | B2 * | 3/2008 | Siu et al. | 446/473 |
| 7,481,727 | B2 * | 1/2009 | Chia | 473/577 |
| 7,565,866 | B1 * | 7/2009 | Downes | 102/482 |
| 7,784,455 | B1 * | 8/2010 | Chong | 124/73 |
| 7,963,351 | B2 * | 6/2011 | Troy | 180/8.1 |
| 8,485,101 | B2 * | 7/2013 | Frank | 102/498 |
| 2002/0182976 | A1 * | 12/2002 | Greene | 446/473 |
| 2003/0036335 | A1 * | 2/2003 | Juy | 446/181 |
| 2007/0249262 | A1 * | 10/2007 | Siu et al. | 446/473 |
| 2008/0257193 | A1 * | 10/2008 | Siu et al. | 102/498 |
| 2010/0072895 | A1 * | 3/2010 | Glynn et al. | 315/76 |

* cited by examiner

TOY HAND GRENADE WITH TIMER MECHANISM

CROSS-REFERENCE TO RELATED APPLICATION

This application is a continuation-in-part of U.S. patent application Ser. No. 13/090,528 filed on Apr. 20, 2011 now U.S. Pat. No. 8,469,011, the disclosure of which is incorporated by reference in its entirety.

BACKGROUND

This disclosure relates generally to action toys. More particularly, this disclosure relates to toys which simulate weapons.

SUMMARY

Briefly stated, a toy hand grenade comprises an oval-like retainer body having a plurality of bores. A pivotal catch has an upper latch and opposed trigger lever and a spring loaded launcher for each bore. Each of the launchers is engaged by the catch. An actuator extends exteriorly from the body and is slidable between an actuated and an unactuated position. The actuator is interiorly engageable against the launcher to retain the launcher in a cocked position when the actuator is an unactuated position. A removable member locks the actuator in the unactuated position. A dart is received in each bore and is engageable against the launcher.

A timer assembly is settable to prevent the actuator from being forced into an actuated position for a time delay period. A ring is mounted to the body and encircles exterior portion of the actuator. When the body is tossed, the ring supports the body in an upright orientation on a surface, and the actuator is forced to the actuated position wherein the actuator causes the trigger levers to pivot to release the launchers and cause said darts to be ejected from the bores.

The body has a truncated end portion defining a pair of generally radial slots and the actuator has a key tab angularly alignable with one of said slots. The actuator is forced to the actuated position upon angular alignment of the key tab with said one slot. In one embodiment, a detonator head receives a portion of the actuator and encloses a clock spring encircling the actuator. The actuator is rotatable under the force of the clock spring to angularly move the key to align with said one slot to force the actuator to the actuated position. The detonator head may also have a cavity which contains a gel. The ring is preferably a sandbag ring. The sandbag ring is mounted adjacent a truncated end portion of the body. When the body is supported in an upright orientation on a surface, the actuator is axially disposed above the surface.

Each launcher has a generally T-shaped cross-section. The catch and the trigger lever are disposed at a substantially oblique angle about a medial pivot point. The actuator has an enlarged head. In one embodiment, the member is a pin and the actuator comprises an opening for receiving the pin. The removable member is a generally U-shaped clip in a second embodiment. The darts are preferably manufactured from soft compressible material. A string may extend from the launcher and be pulled for cocking the launcher. Alternatively, the removable member may be used as a tool for cocking the launcher.

DETAILED DESCRIPTION

Figure 1:
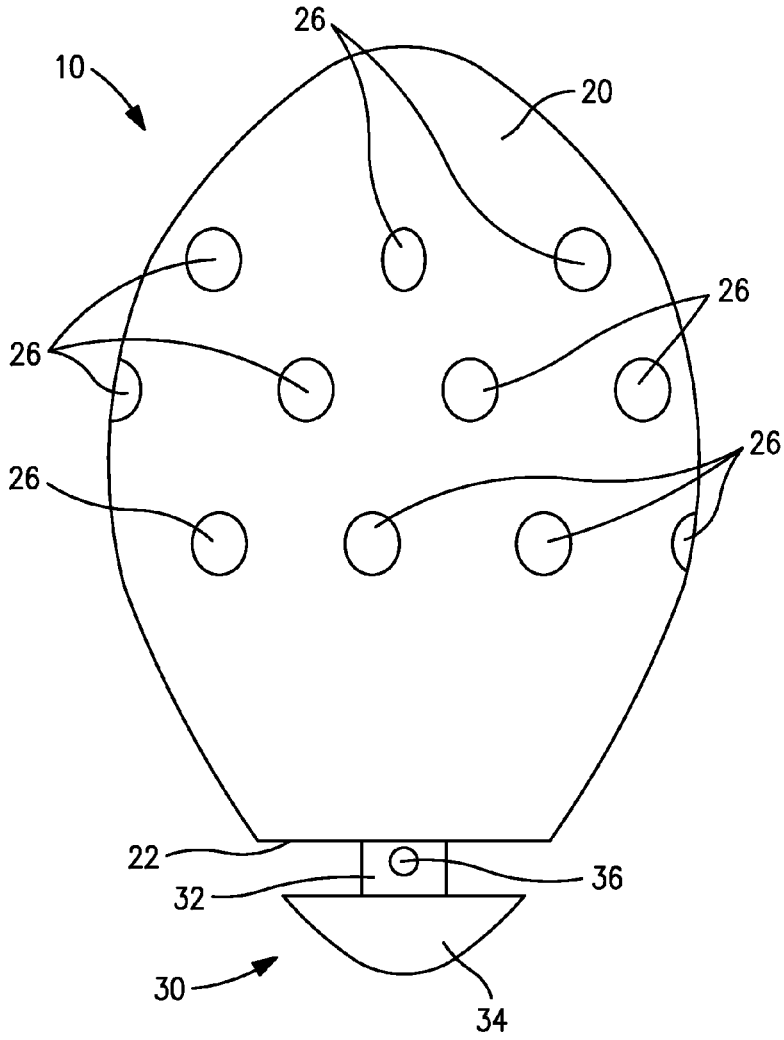
FIG. 1 is a side elevational view of a toy hand grenade, portions removed.

With reference to the drawings wherein like numerals represent like parts throughout the several figures, a toy hand grenade is generally designated by the numeral 10. The toy hand grenade 10 is adapted to generally resemble a hand grenade in overall appearance and is configured to function in a way that simulates the general action of the hand grenade for purposes of child's play and in a child-safe manner.

The toy hand grenade 10 includes a general oval shaped body 20 which at one end 22 is truncated. An actuator 30 extends from a throughbore 24 at the truncated end 22 of the body. The actuator 30 includes a stem 32. The stem connects with a generally enlarged contoured detonator head 34.

The body 20 defines a plurality of cylindrical bores 26 which in one form are generally identical in shape and dimension. The bores 26 open through the body surface and extend interiorly into the body in a direction generally toward a central portion of the body. Alternatively, the bores may be formed by sleeves.

Figure 2:
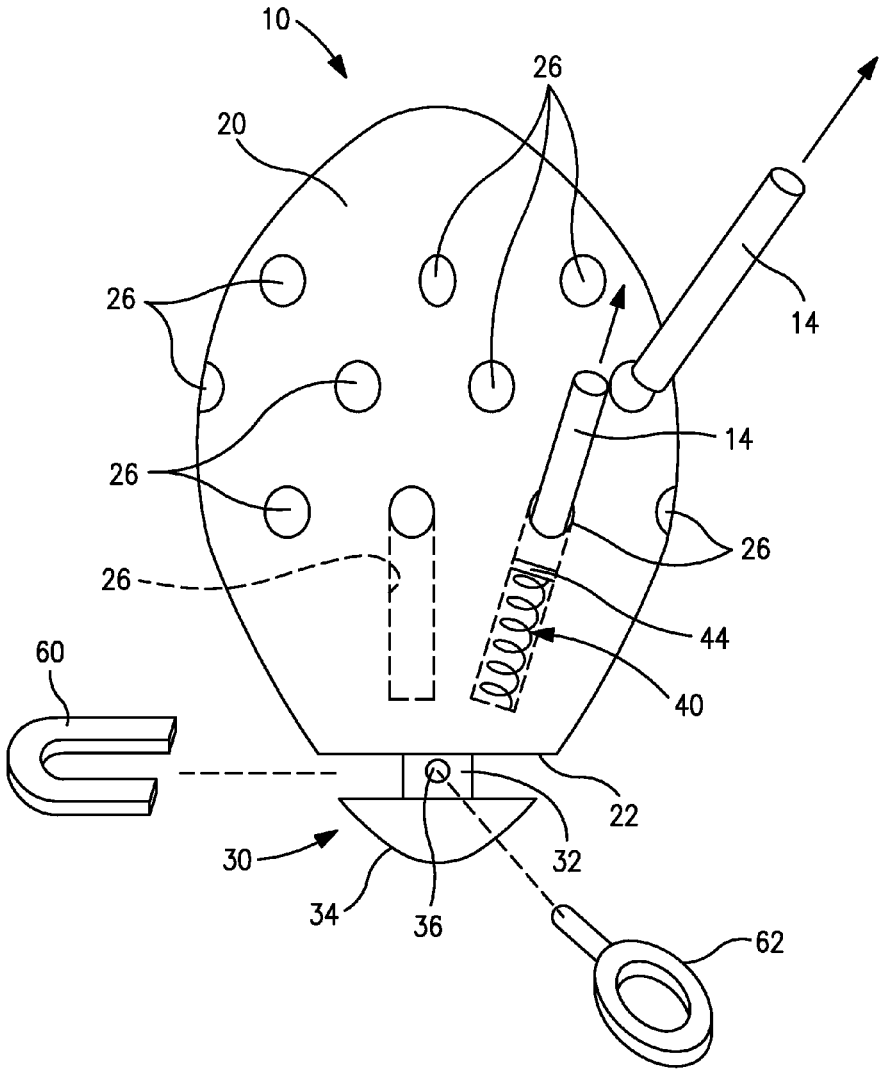
FIG. 2 is a side elevational view, partly in diagram form and partly in phantom, of the toy hand grenade of FIG. 1.
Figure 3:
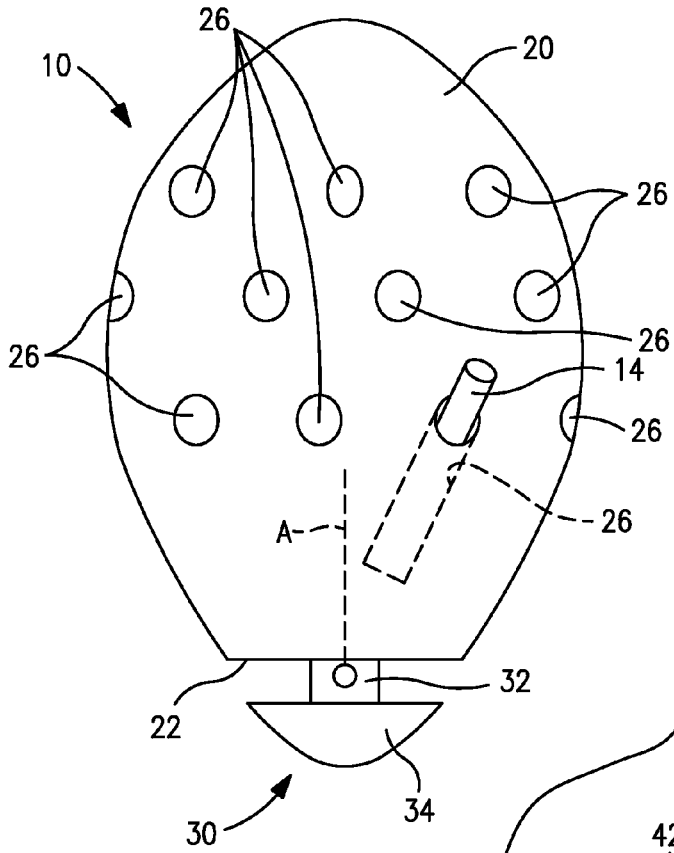
FIG. 3 is an elevational view, partly in phantom, of the toy hand grenade of FIG. 1 together with a representative dart.
Figure 4:
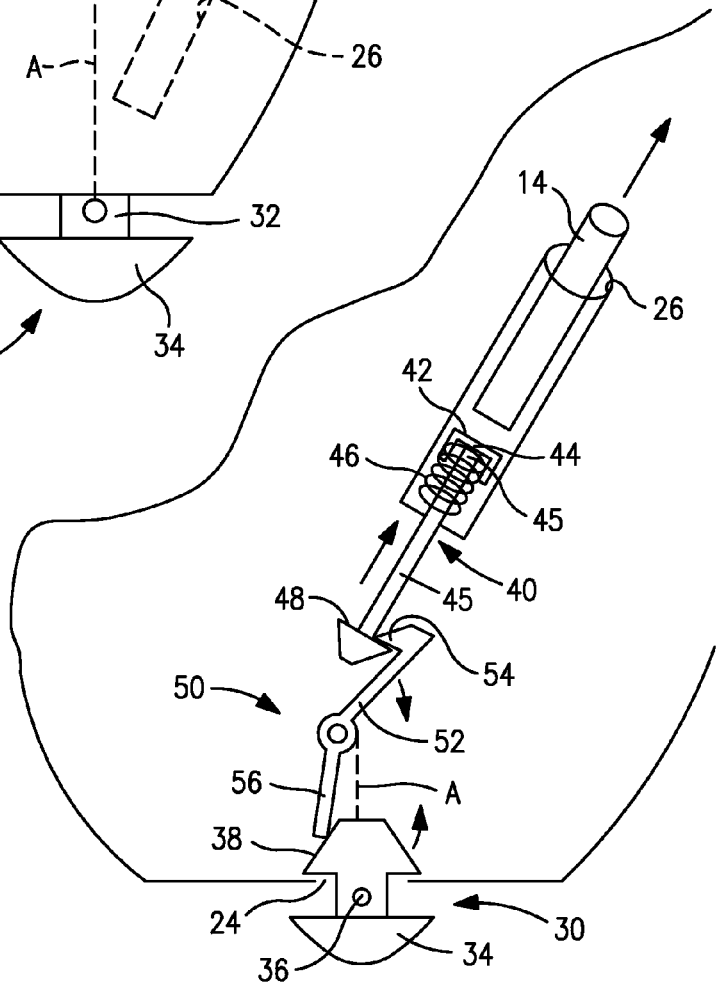
FIG. 4 is an enlarged fragmentary view, partly in schematic and partly in diagram form, illustrating the operation of the toy hand grenade of FIG. 1.

With reference to FIGS. 2-4, each of the bores 26 receives and generally houses a dart 14. Each dart 14 is manufactured from a foam or soft compressible material. The darts 14 may be cylindrical as illustrated or assume various other shapes.

With reference to FIG. 4, a launcher 40 is positioned at the interior end portion of each bore 26. Upon loading a dart in a bore, the lower end of the dart engages an injector cap 42 of the launcher. The launcher 40 has a T-shaped end 44 including a leg 45. The launcher captures a compression spring 46 disposed between the end of the bore and the underside of the end 44 and coiled around the leg 45. The leg 45 extends inwardly into the body and mounts an end flange 48.

Each launcher 40 has an associated trigger 50. Each trigger 50 includes an obliquely angled lever arm 52 which is pivotally mounted at an intermediate location at the interior of the body. The trigger includes a latch 54 which engages the flange 48 of the launcher. The opposed end of the trigger includes an integral arm 56.

The actuator 30 includes a truncated conical head 38 having a surface which engages each of the arms 56 of each of the triggers as they are angularly arranged about the central axis A of the body. In an actuated position, the latch 54 of the trigger engages the retention flange 48 of the launcher to compress the spring 46 and retract the ejector cap 42. The latch position is ensured by the engagement of the arm 56 against the surface of head 38.

When the actuator 30 is axially displaced, as shown by the associated arrow in FIG. 4, the arm rides down the surface and causes the trigger 50 to pivot and thereby disengage the latch 54 to release the launcher 40 which is loaded under the spring force. Each launcher ejector cap 42 engages the end of each dart 14 to substantially concurrently propel each dart from a bore 24. The FIG. 4 arrows illustrate the dart ejection (detonation) moment.

It will be appreciated that there are multiple bores 26 each with a launcher 40. In addition each launcher 40 has an associated trigger 50 which secures the launcher in a spring-loaded pre-actuated position.

The relationship between the spring loaded launcher 40 and the trigger 50 as engaged by the surface of head 38 is such that the launcher 40 is maintained in the primed cocked condition. The relationship between the actuator stem 32 and the corresponding throughbore 24 of the body may also be sufficiently tight that ordinarily, the actuator will be retained in a quasi-force-fit relationship spaced from the truncated end 22.

With reference to FIG. 2, a clip 60 is inserted around the stem to maintain the cocked (locked) position. Alternatively, a pin 62 may be inserted through an opening 36 of the stem to lock the actuator 30.

Figure 5:
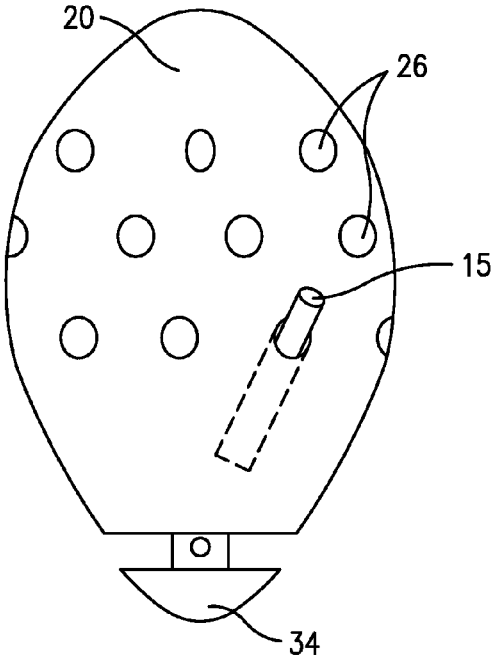
FIG. 5 is an elevational view, partly in phantom, of the toy hand grenade of FIG. 1, together with a tool employed for cocking the hand grenade.
Figure 6:
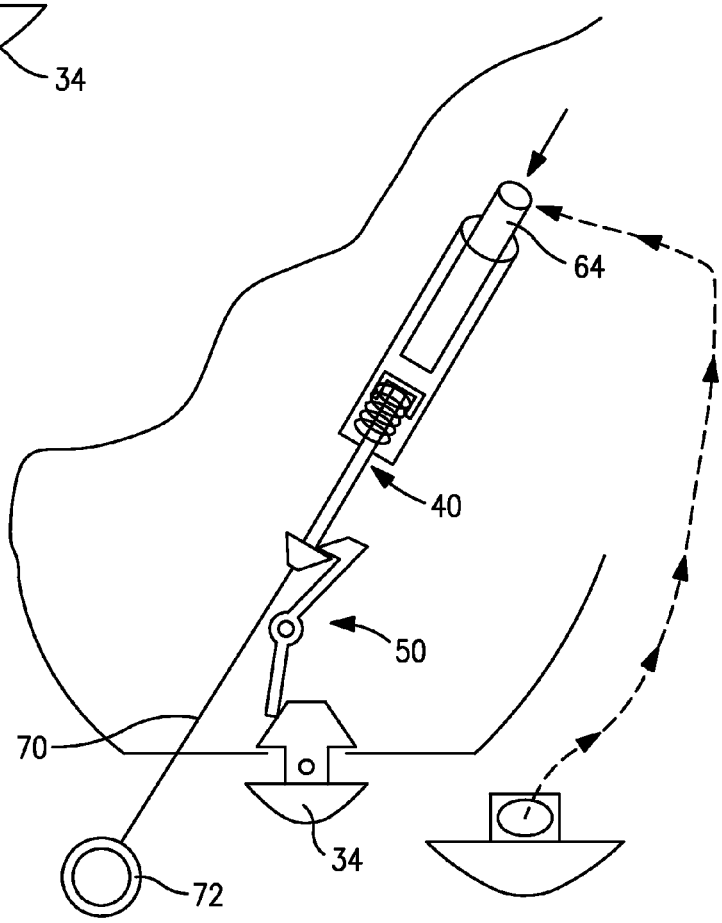
FIG. 6 is an enlarged fragmentary view, partly in schematic and partly in diagram form, further illustrating two methods of cocking the toy hand grenade of FIG. 1.

With reference to FIGS. 5 and 6, the grenade may be primed or cocked in a number of ways. A rigid dart shaped tool 15 may be employed to compress each spring prior to loading a foam dart 14. Alternatively, each launcher 40 piston can be retracted into tension by a member connected to an activating button (not illustrated). As illustrated in FIG. 6, a pull string 70 connects each launcher 40 and extends through the actuator end. The pull string 70 preferably has a ring 72. The ring and/or string are pulled to compress the spring for priming the launcher 40. In some embodiments, the actuator pull pin 64 essentially functions as the priming tool 15.

In operation, clip 60 or pin 62 or pin 64 is removed. The grenade weight is distributed at the actuator end so that the actuator head 34 ordinarily initially strikes the ground when the grenade is thrown. The toy hand grenade 10 is thus thrown so that the actuator head 34 engages a surface and moves in the direction of the associated FIG. 4 arrow to release the triggers and activate the launchers 40 to thereby propel the darts 14 from the body 20.

Figure 7:
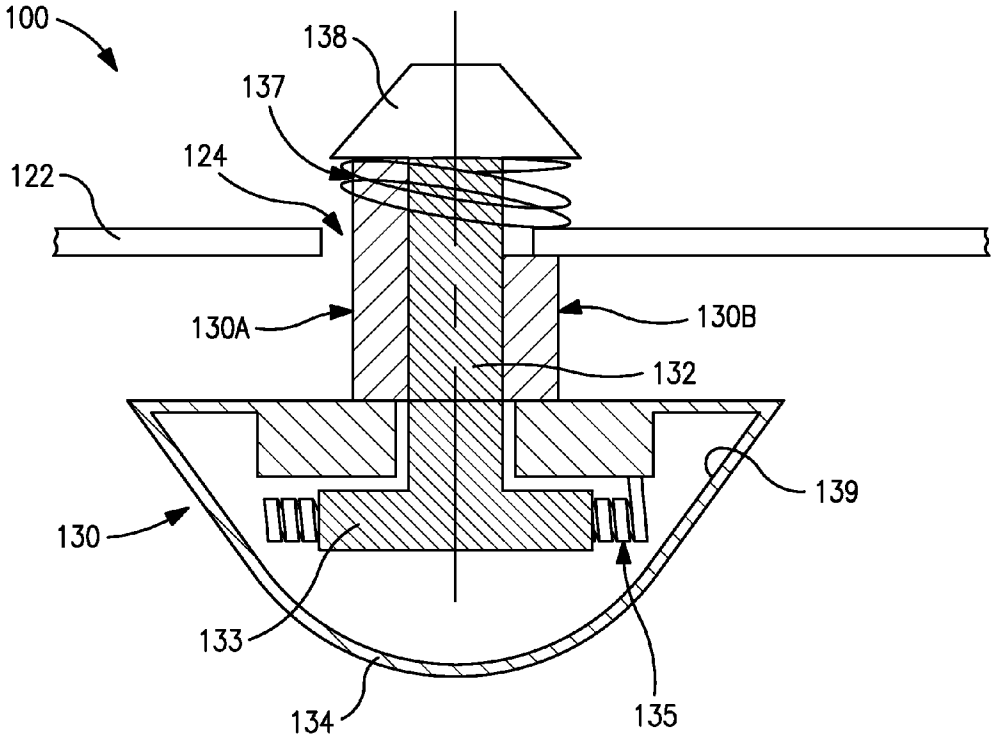
FIG. 7 is an enlarged fragmentary side view, portions broken away, illustrating a toy hand grenade which incorporates a timer.
Figure 9:
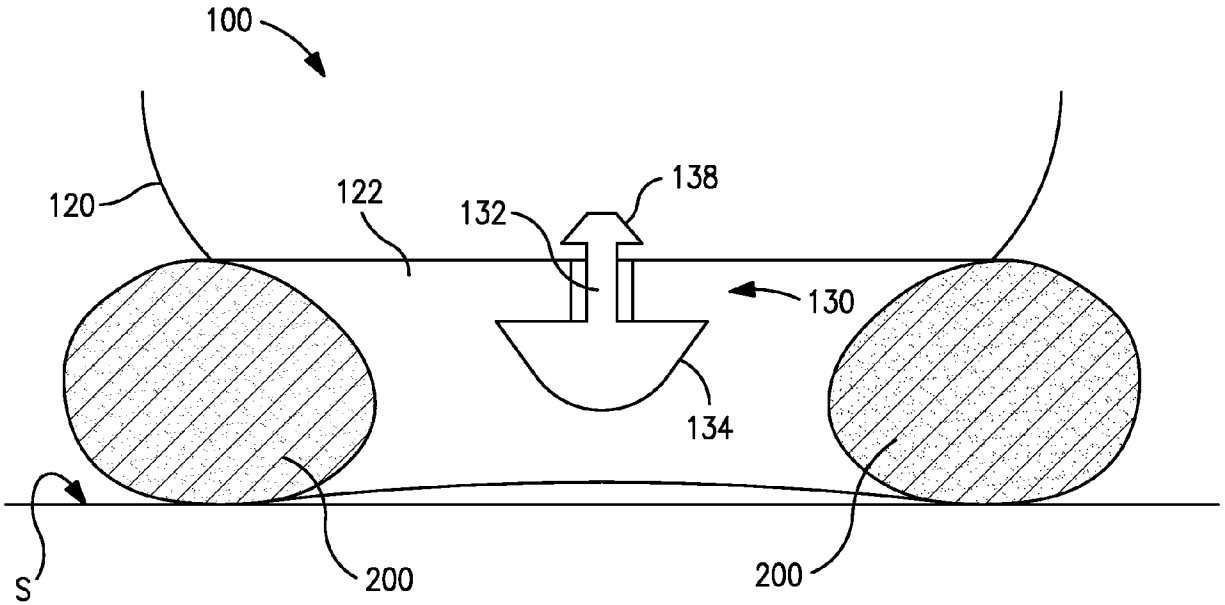
FIG. 9 is a fragmentary sectional view, portions removed, of the timer actuated toy hand grenade of FIG. 7 with the toy hand grenade resting on a surface.
Figure 8:
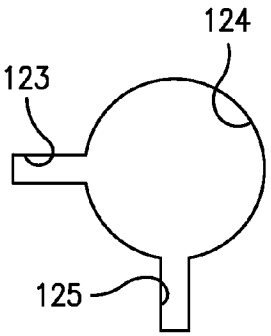
FIG. 8 is a top plan view of an opening through one end of the timer activated toy hand grenade of FIG. 7.

With reference to FIGS. 7-9, a partially illustrated toy hand grenade which incorporates a delayed timer actuation feature is generally designated by the numeral 100. Hand grenade 100 generally has the same features as toy hand grenade 10 except for the modifications described below.

The toy hand grenade 100 generally has an oval shaped body similar to body 20 and wherein (lower) end 122 is truncated. An actuator stem 132 for an actuator 130 extends through a throughbore 124 at the truncated end of the body. The throughbore 12 has a central circular opening with radial slots 123 and 125 which are generally disposed perpendicularly relative to a central axis through the throughbore 124. The actuator 130 includes a stem 132 which connects exteriorly of the body 20 with a generally enlarged contoured detonator head 134 and interiorly with a truncated conical head 138. The truncated conical head 138 of the actuator has a surface which engages each of the arms 56 of each of the triggers 50 as previously described.

The mechanism for achieving the axial displacement of the acuator 130 is different than that previously described in that movement of the actuator is subject to a delay timer mechanism. The actuator stem 132 includes a radial key tab 130B which projects outwardly from a portion of the stem 132. The end of the body defines the throughbore 124 and the pair of slots 123, 125 disposed in a generally 270° orientation from the circular opening (see FIG. 8). Slot 123 receives an anti-rotation key 130A which extends from underside of the head 138 to the top of the detonator head 134. The head 134 houses a T-shaped (in section) end 133 of the actuator stem which can be spring loaded by a clock spring 135 so that the stem is biased for rotation approximately 270° as will be further described.

The top surface of the head 134 supports anti-rotation key 130A which extends through slot 123 and engages the underside of the actuator head 138 to define a gap between the end 122 and the top of the head 134 when key tab 130B is in the angular position which is offset from slot 125 as shown in FIG. 8. A compression spring 137 is mounted around the upper actuator stem 132 and the key 130A. At the underside of the actuator head 138, the spring engages against the inside of the truncated end to bias the actuator stem 132 axially upwardly. Key tab 130B engages the underside of the end to maintain the gap between the end 122 and the top of the detonator head 134. The gap is also preferably maintained by clip 60. The head 134 is rotated so that the actuator stem 132 is rotatably biased by the clock spring 135. Upon rotation and due to the uncoiling of the spring 135, the key 130B reaches the angular position of slot 125. The key tab 130B aligns with the slot 125 while the spring 137 biases the actuator stem upwardly. The key tab 130B is thus free to move upwardly (biased by spring 137) through the slot 125 and release the actuator stem. The actuator head 138 accordingly moves to pivot the triggers 50 so that the launchers 40 are activated. The interior 139 of head 134 is preferably filled with a gel to slow the rotation of the key tab 130B.

In order to ensure the impact orientation of the hand grenade when tossed, the bottom portion of the hand grenade body 120 preferably mounts a sandbag ring 200 which extends downwardly, as best illustrated in FIG. 9. When the toy hand grenade lands, it is maintained in an upright position on surface S due to the weight and configuration of the sandbag ring 200. Upon landing the actuator head 134 is entirely axially disposed above the surface. When the timer times out and the actuator is axially forced upwardly, the darts 14 are propelled from the hand grenade. Other delay timer mechanisms may also be employed.

The toy hand grenade 100 is preferably detonated as follows: The clip 60 or the pin 62/64 is removed. The timer is set by coiling the clock spring 135 to set the timing function. The toy hand grenade 100 is then tossed. Upon landing on a surface, the grenade 100 is supported on the sandbag ring 200 and the body is essentially oriented in an upright fashion. Upon timing out of the timer, the actuator moves upwardly and the darts 14 are substantially concurrently launched.

What is claimed is:

1. A toy hand grenade comprising:

a body having a plurality of bores;

a pivotal catch having an upper latch and an opposed trigger lever;

a spring loaded launcher for each said bore engaged by said catch;

an actuator extending exteriorly from said body and slidable therewith between an actuated and an unactuated position, said actuator interiorly engageable against said launcher to retain said launcher in a cocked position when said actuator is in an unactuated position;

a plurality of darts each received in a said bore and engageable against a said launcher;

a timer assembly which is settable to prevent said actuator from being forced to an actuated position for a time delay period; and a ring mounted to said body and encircling an exterior portion of said actuator;

so that when said body is tossed, said ring supports said body in an upright orientation on a surface, and said actuator is forced to the actuated position, wherein said actuator causes said trigger levers to pivot to release said launchers and cause said darts to be ejected from said bores.

2. The toy hand grenade of claim 1 wherein said body has an end portion defining a pair of generally radial slots and said actuator has a key tab angularly alignable with one of said slots and said actuator is forced to the actuated position upon angular alignment of said key tab with said one slot.

3. The toy hand grenade of claim 2 further comprising a detonator head receiving a portion of said actuator and enclosing a clock spring encircling said actuator, and wherein said actuator is rotatable under the force of said clock spring to angularly move said key to align with said one slot to force the actuator to the actuated position.

4. The toy hand grenade of claim 3 wherein said detonator head further defines a cavity with a gel being disposed in said cavity.

5. The toy hand grenade of claim 1 wherein said ring further comprises a sandbag ring.

6. The toy hand grenade of claim 5 wherein said sandbag ring is mounted adjacent a truncated end portion of said body, and when the body is supported in an upright orientation on a surface, the actuator is axially disposed above said surface.

7. A toy hand grenade comprising:

a retainer body having a plurality of bores;

a pivotal catch having an upper latch and an opposed trigger lever;

a spring loaded launcher for each said bore engaged by said catch;

an actuator extending exteriorly from said body and slidable therewith between an actuated and an unactuated position, said actuator interiorly engageable against said launcher to retain said launcher in a cocked position when said actuator is in an unactuated position;

a removable member for locking said actuator in the unactuated position;

a plurality of darts each received in a said bore and engageable against a said launcher, a timer assembly which is settable to prevent said actuator from being moved to an actuated position for a time delay period, so that when said member is removed and said actuator is moved to the actuated position, said actuator causes said trigger levers to pivot to release said launchers and cause said darts to be ejected from said bores.

8. The toy hand grenade of claim 7 wherein said body has a truncated end portion defining a pair of generally radial slots and said actuator has a key tab angularly alignable with one slots and said actuator is forced to the actuated position upon angular alignment of said key tab with said corresponding slot.

9. The toy hand grenade of claim 8 further comprising a detonator head receiving a portion of said actuator and enclosing a clock spring encircling said actuator, and wherein said actuator is rotatable under the force of said clock spring to angularly move said key to align with said slot to force the actuator to the actuated position.

10. The toy hand grenade of claim 9 wherein said detonator head further defines a cavity with a gel being disposed in said cavity.

11. The toy hand grenade of claim 7 further comprising a sandbag ring mounted to said retainer body.

12. The toy hand grenade of claim 11 wherein said ring is mounted adjacent a truncated end portion of said retainer body, and when the sandbag ring is supported on a surface, the actuator head is axially disposed above said surface.

13. A toy hand grenade comprising:

a retainer body having a plurality of bores;

a catch having an upper latch and an opposed trigger lever;

a spring loaded launcher for each said bore engaged by said catch;

an actuator extending exteriorly from said body and slidable therewith between an actuated and an unactuated position, said actuator interiorly engageable against said launcher to retain said launcher in a cocked position when said actuator is in an unactuated position;

a plurality of darts each received in a said bore and engageable against a said launcher; and a timer assembly which is rotatably settable to prevent said actuator from being released to an actuated position for a time delay period, so that when said actuator is forced to the actuated position, said actuator causes said trigger levers to release said launchers and cause said darts to be ejected from said bores.

14. The toy hand grenade of claim 13 wherein each said launcher has a generally T-shaped cross-section.

15. The toy hand grenade of claim 13 wherein said catch and said trigger lever are disposed at a substantially oblique angle about a medial pivot point.

16. The toy hand grenade of claim 13 wherein said actuator has an enlarged head.

17. The toy hand grenade of claim 13 and further comprising a removable member for locking said actuator in the unactuated position.

18. The toy hand grenade of claim 17 wherein said member is a pin and said actuator comprises an opening for receiving said pin.

19. The toy hand grenade of claim 13 wherein said darts are manufactured from soft compressible material.

20. The toy hand grenade of claim 19 further comprising a ring mounted to said retainer body and axially extending exteriorly beyond the actuator in the unactuated position.

* * * * *